US005141554A

United States Patent [19]

Kijima

[11] Patent Number: 5,141,554

[45] Date of Patent: Aug. 25, 1992

[54] INJECTION-MOLDED SINTERED ALLOY STEEL PRODUCT

[75] Inventor: Yoshio Kijima, Tokyo, Japan

[73] Assignee: Sumitomo Metal Mining Co., Ltd., Tokyo, Japan

[21] Appl. No.: 716,742

[22] Filed: Jun. 14, 1991

Related U.S. Application Data

[62] Division of Ser. No. 591,976, Oct. 2, 1990, abandoned.

[30] Foreign Application Priority Data

Oct. 6, 1989 [JP] Japan ..... 1-260068
Jul. 6, 1990 [JP] Japan ..... 2-177230

[51] Int. Cl.[5] ..... C22C 38/02
[52] U.S. Cl. ..... 75/246; 75/242
[58] Field of Search ..... 75/242, 243, 246

[56] References Cited

U.S. PATENT DOCUMENTS 3,856,478 12/1974 Iwata et al. ..... 75/246
3,929,423 12/1975 Finkl ..... 75/246
4,253,874 3/1981 Cundill ..... 75/246

*Primary Examiner*—Deborah Yee
*Attorney, Agent, or Firm*—Watson, Cole, Grindle & Watson

[57] ABSTRACT

An alloy steel for use in injection-molded sinterings produced by powder metallurgy which comprises by weight, from 0.5 to 3% of Cr and/or Mn, from 0.3 to 1% of C, and balance Fe, is claimed.

The alloy steel according to the present invention provides injection-molded sinterings having favorable post workability well-comparable to that of Fe-Ni-C alloys, and further improved in abrasion resistance when hardened and tempered to give a high Vickers hardness of over Hv 700.

1 Claim, No Drawings

INJECTION-MOLDED SINTERED ALLOY STEEL PRODUCT

CROSS-REFERENCE TO RELATED APPLICATION

The present application is a divisional of application Ser. No. 591,976, filed Oct. 2, 1990, now abandoned.

FIELD OF THE INVENTION

The present invention relates to an alloy steel for use in injection-molded sinterings produced by powder metallurgy, which sinterings are particularly improved in hardenability.

BACKGROUND OF THE INVENTION

Sinterings having three-dimensionally complicated shapes are currently manufactured by powder metallurgy using an injection molding process. This process comprises the steps of kneading a binder with a metal powder such as pure iron, an Fe-Ni system alloy, an Fe-Ni-C system alloy, high speed steel, precipitation-hardened steel, stainless steel, and sintered carbide, then injection-molding the kneaded mixture and then sintering the debindered molding. Sintered alloys produced by this method are in general, subjected to post treatment or working. In this regard, sizing, followed by treatments such as milling, swaging or punching, tapping, barrel-polishing, and the like, as well as heat treatments such as hardening-tempering, softening, magnetic annealing, aging, and HIP treatment (hot isostatic pressing), can be employed to thereby obtain the final products. There have been, widely increasing demands that the as-sintered products have excellent post workability and that they possess favorable abrasion resistance, which should result from favorable surface hardenability upon hardening and tempering. Fe-Ni-C alloys have been considered to be the best at achieving such results. In this regard, sintered Fe-Ni-C alloys have good post workability indeed; however, their hardenability is yet to be improved. That is, it is not possible to obtain an oil-hardened and tempered product therefrom which yields a hardness (Hv) which exceeds 700, and therefore the abrasion resistance is a disadvantage.

SUMMARY OF THE INVENTION

It is an object of the present invention to provide an alloy steel for use in injection-molded sinterings produced by powder metallurgy which exhibits post workability which is comparable to that of Fe-Ni-C alloys and which at the same time yields a surface hardness exceeding Hv 700 after heat treatment.

The aforementioned object is accomplished by an alloy steel for use in injection-molded sinterings produced by powder metallurgy, which comprises, by weight, from 0.5 to 3% of Cr and/or Mn, from 0.3 to 1% of C, and a balance of Fe.

DETAILED DESCRIPTION OF THE INVENTION

The alloy of the present invention comprises Cr and/or Mn as essential elements for improving hardenability, and C also as an essential element to maintain favorable hardenability. When the Cr and/or Mn accounts for less than 0.5% by weight, and/or C for less than 0.3% by weight, the hardenability of the resulting alloy remains still unsatisfactory; when the amount of Cr and/or Mn exceeds 3% by weight, and/or that of C exceeds 1% by weight, the post-workability is impaired since the resulting as-sintered product becomes too hard. Accordingly, the Cr and/or Mn content is set to a range of from 0.5 to 3% by weight and C content is confined in the range of from 0.3 to 1% by weight.

The object of the present invention is now achieved by preparing a metallic powder as above stated and sintering the injection-molding obtained therefrom following a powder metallurgy process.

EXAMPLES

Now the invention is described in further detail with reference to non-limiting Examples.

EXAMPLE 1

A water-atomized fine powder (30 μm in average particle diameter) of an Fe-Cr alloy containing 30% by weight of Cr (hereinafter Fe-30wt.%Cr alloy) as the mother alloy was mixed with carbonyl iron powder (5 μm in average particle diameter) containing 0.9% by weight of carbon and natural graphite powder (22 μm in average particle diameter) at ratios as shown in Table 1, and to the mixture was further added an organic binder to make a total of 10 kg. The resulting mixture was kneaded, and was injection-molded in a metal mold to obtain a test piece 10 mm in width, 10 mm in thickness, and 55 mm in length. Thus were obtained test pieces No.1 to No.7.

The molded test pieces were debindered in nitrogen atmosphere at 300 ° C., and subjected to sintering in a semicontinuous vacuum sintering furnance at 1250° C. under vacuum of $5\times10^{-2}$ Torr to obtain sound sinterings. The sinterings had a relative density ranging from 93% to 95%, depending on the composition.

Vickers hardness of the sintering was measured applying a load of 10 kg. The sinterings thereafter were subjected to oil-quenching and tempering. Quenching was carried out by oil-quenching a sintering maintained at 830 ° C. For 30 minutes. Tempering comprised air-cooling a sintering maintained at 170° C. for 60 minutes. Vickers hardness under 10-kg load was then measured again on each of the heat-treated sintering.

Test piece No. 8 was then prepared in the same manner as described above, except for using a carbonyl iron powder (5 μm in average particle diameter) containing 0.9 % by weight of carbon and carbonyl nickel powder (7 μm in average particle diameter) at amounts shown in Table 1. Vickers hardness was also measured on this sintering having a relative density of 95%.

The measured hardness for the sintering and the heat-treated products are given in Table 1.

TABLE 1

| | Chemical composition (weight %) | | | | Vickers Hardness (Hv) | |
|---|---|---|---|---|---|---|
| | Cr | Ni | C | Fe | as-sintered | heat-treated |
| Invention 1 | 0.5 | — | 0.5 | bal. | 210.5 | 705.4 |
| Invention 2 | 1.0 | — | 0.5 | bal. | 236.4 | 720.0 |
| Invention 3 | 2.5 | — | 0.5 | bal. | 258.2 | 760.2 |
| Invention 4 | 1.0 | — | 0.9 | bal. | 252.3 | 743.1 |
| Comparative 5 | 0.3 | — | 0.5 | bal. | 182.1 | 606.3 |
| Comparative 6 | 3.5 | — | 0.5 | bal. | 350.6 | 780.3 |
| Comparative 7 | 1.0 | — | 1.2 | bal. | 290.6 | 725.4 |
| Prior Art 8 | — | 2.0 | 0.5 | bal. | 190.4 | 635.5 |

Table 1 reads that the as-sintered alloys according to the present invention have a low Hv of 260 or less. This signifies that the post workability of the alloys according to the present invention is quite comparable to that of the prior art alloy. Concerning the heat-treated alloys of the present invention, the hardness HV thereof exceeded 700, clearly indicating a superiority in hardenability.

EXAMPLE 2

A mechanically crushed fine powder (8 μm in average particle diameter) of an Fe-Mn alloy containing 77% by weight of Mn (hereinafter Fe-77wt.%Mn alloy) as the mother alloy was mixed with carbonyl iron powder (5 μm in average particle diameter) containing 0.05% or 0.9% by weight of carbon and natural graphite powder (22 μm in average particle diameter) at ratios as shown in Table 1, and to the mixture was further added an organic binder to make a total of 10 kg. The resulting mixture was kneaded, and the kneaded product was injection-molded in a metal mold to obtain a test piece 10 mm in width, 10 mm in thickness, and 55 mm in length. Thus were obtained test pieces No. 9 to No. 15.

The molded test pieces were sintered in the same manner as in Example 1, to obtain sinterings having a relative density ranging from 92% to 95%, depending on the composition.

The hardness of the sinterings was measured in the same manner as in Example 1. Subsequent heat treatment and the hardness measurement on the heat-treated sinterings were carried out in accordance with the method described in Example 1.

The measured hardness for the sinterings and the heat-treated products are given in Table 2.

TABLE 2

| | Chemical composition (weight %) | | | | Vickers Hardness (Hv) | |
|---|---|---|---|---|---|---|
| | Mn | Ni | C | Fe | as-sintered | heat-treated |
| Invention 9 | 0.5 | — | 0.5 | bal. | 180.6 | 706.2 |
| Invention 10 | 1.0 | — | 0.5 | bal. | 210.3 | 719.8 |
| Invention 11 | 2.5 | — | 0.5 | bal. | 265.2 | 748.3 |
| Invention 12 | 1.0 | — | 0.9 | bal. | 236.4 | 732.8 |
| Comparative 13 | 0.3 | — | 0.5 | bal. | 175.4 | 652.7 |
| Comparative 14 | 3.5 | — | 0.5 | bal. | 335.3 | 792.4 |
| Comparative 15 | 1.0 | — | 1.2 | bal. | 275.3 | 724.5 |

Table 2 reads that the as-sintered alloys according to the present invention have a low Hv of 270 or less. This signifies that the post workability of the alloys according to the present invention if quite comparable to that of the prior art alloy. Concerning the heat-treated alloys of the present invention, the hardness Hv thereof exceeds 700, clearly indicating superiority in hardenability.

What is claimed is:

1. A injection-molded product which has been sintered and heat treated and which consists of 0.5 to 3% by weight of at least one metal selected from the group consisting of Cr and Mn, 0.3 to 1% by weight of C, and a balance of Fe, said product having a Vickers hardness Hv of at least 700.

* * * * *